US005238424A

United States Patent [19]

Vindum

[11] Patent Number: 5,238,424

[45] Date of Patent: Aug. 24, 1993

[54] IN-LINE EXTENSION CORD

[76] Inventor: Jorgen O. Vindum, 1 Woodview Ct., San Ramon, Calif. 94583

[21] Appl. No.: 11,090

[22] Filed: Jan. 29, 1993

Related U.S. Application Data

[63] Continuation of Ser. No. 802,991, Dec. 5, 1991, abandoned.

[51] Int. Cl.[5] ..... H01R 4/24

[52] U.S. Cl. ..... 439/425; 439/431; 439/505

[58] Field of Search ..... 439/492–499, 439/465, 466, 467, 731, 752, 425–427, 395–407, 505, 431

[56] References Cited

U.S. PATENT DOCUMENTS

| | | | |
|---|---|---|---|
| 2,515,256 | 7/1950 | O'Brien et al. . | |
| 2,700,752 | 1/1955 | Cataldo . | |
| 2,952,829 | 9/1960 | Grohsgal . | |
| 2,963,676 | 12/1960 | Sneesby et al. . | |
| 2,979,624 | 4/1961 | Askerneese . | |
| 4,023,883 | 5/1977 | Raposa et al. | 439/402 |
| 4,500,150 | 2/1985 | Leibensperger et al. . | |
| 4,758,536 | 7/1988 | Miller et al. | 439/405 |
| 4,867,701 | 9/1989 | Wiand . | |
| 4,930,047 | 5/1990 | Peterson . | |
| 4,934,953 | 6/1990 | Tenham et al. | 439/417 |
| 4,941,845 | 7/1990 | Eppley et al. . | |
| 5,038,001 | 8/1991 | Koegel et al. | 439/497 |

FOREIGN PATENT DOCUMENTS

| | | | |
|---|---|---|---|
| 2075772 | 11/1981 | United Kingdom | 439/418 |

*Primary Examiner*—David L. Pirlot

*Attorney, Agent, or Firm*—Townsend and Townsend Khourie and Crew

[57] ABSTRACT

An extension cord (2) has an electrical cord (6) with an asymmetrical cross section (8) and one or more modular sockets (4). The electrical cord has a plurality of electrical conductors (12) extending throughout its length and a plug at one end. The modular socket can be attached anywhere along the length of the electrical cord. The modular socket has two parts (18, 20) forming an opening (44) which houses the cord, the opening being of substantially the same effective asymmetrical cross section as the cord. When the modular socket is fastened to the cord, spikes (24) in the modular socket pierce the cord's insulating material (26) and contact the conductors running through the cord. The spikes electrically connect the cord's conductors with the plug's electrical contacts (16). The asymmetrical cross section ensures proper polarity for the modular socket.

2 Claims, 1 Drawing Sheet

IN-LINE EXTENSION CORD

This is a continuation of application Ser. No. 07/802,991, filed Dec. 5, 1991, now abandoned.

BACKGROUND OF THE INVENTION

Extension cords typically have a plug at one end and one or more sockets at the other. Extension cords effectively "extend" other electrical cords, such as appliance cords.

Conventional extension cords are limited since they provide sockets only at the end of the cord. Many household and office spaces have multiple electric appliances and equipment. An office desk may have a computer, monitor, printer and light, while a family room may have a television, telephone, light, and stereo. In a room where the appliances are spread apart, a single extension cord having sockets only at one location cannot service all the appliances. For these applications, a number of extension cords is often required. This can create an unsightly and sometimes dangerous situation.

SUMMARY OF THE INVENTION

The extension cord of the present invention can provide sockets anywhere along the length of the extension cord. The extension cord has a flexible electrical cord with an asymmetrical cross section and modular sockets. As used in this application, asymmetrical cross section includes cross sections which are truly asymmetrical about any axis in the cross-sectional plane and cross sections which are asymmetrical about an axis perpendicular to a line connecting the conductors. The modular sockets can be attached anywhere along the length of the electrical cord. The asymmetrical cord cross section ensures proper polarity for the modular sockets.

The electrical cord has at least two electrical conductors extending throughout its length. The modular sockets can be secured and locked to the electrical cord. Each modular socket has a body with a cord engaging surface configured for complementary engagement with the asymmetrical cord. The socket's contacts are electrically coupled to the cord's conductors when the modular socket is matingly engaged with the asymmetrical cord.

The extension cord has several advantageous features. First, the modular sockets can be connected anywhere along the electrical cord. This feature allows a user to locate appliances anywhere along the cord's length. Thus, a single extension cord can supply power to a number of appliances which are spread apart. The extension cord also has an asymmetrical cross section which ensures proper polarity for the modular socket. The electrical cord is also flexible so it can be run around obstacles and located in places where it can be concealed. Finally, the extension cord reduces the number of cords required in some applications, thereby saving the expense of additional cords, increasing aesthetics by minimizing eye-distracting cords, and reducing the clutter, inconvenience and potential safety hazards of multiple extension cords.

Other features and advantages of the invention will appear from the following description in which the preferred embodiment has been set forth in detail in conjunction with accompanying drawings.

DESCRIPTION OF THE PREFERRED EMBODIMENT

Figure 1:
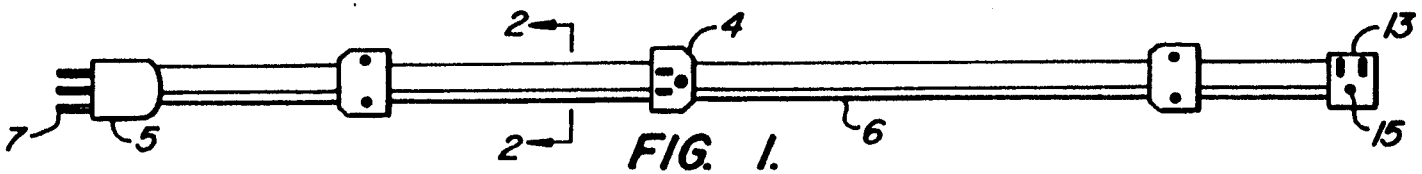
FIG. 1 illustrates an extension cord made according to the invention.

FIG. 1 illustrates an extension cord 2 including a 3-wire electrical cord 6 and a number of modular sockets 4 which can be placed anywhere along the length of electrical cord 6. FIG. 1 shows extension cord 2 with three modular sockets 4 attached along the length of electrical cord 6. Cord 2 also includes a conventional end plug 5 attached to one end of electrical cord 6 and a conventional terminal socket 13 at the other end of cord 6. End plug 5 has a plurality of electrical prongs 7 with the preferred embodiment shown in FIG. 1 having three.

Figure 2:
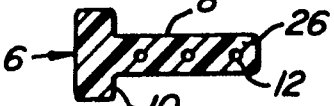
FIG. 2 is a cross-sectional view of the electrical cord of FIG. 1 taken along line 2—2.
Figure 2A:
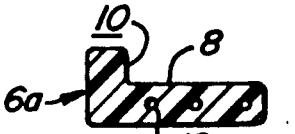
FIG. 2A is a cross-sectional view of an alternative embodiment of the cord shown in FIG. 2.
Figure 3:
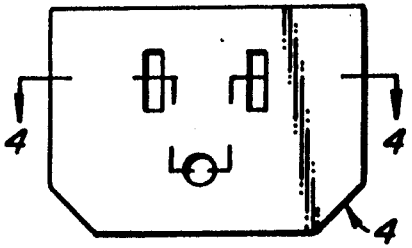
FIG. 3 illustrates the modular plug sockets.

Electrical cord 6, as shown in FIG. 2, has a T-shaped asymmetrical (relative to an axis perpendicular to a line connecting conductors 12) cross section 8 and an asymmetrical line surface 10. Other embodiments could have any other asymmetrical cross section, for example, an L-shaped cross section. See cord 6*a* shown in FIG. 2A. Asymmetrical cross section 8 ensures proper polarity for modular sockets 4 as is discussed below.

Electrical cord 6 also has three conductors 12 extending throughout its length which are electrically coupled to electrical prongs 7 of end plug 5 and to the terminal socket contacts 15 of terminal socket 13 at the other end.

Figure 6:
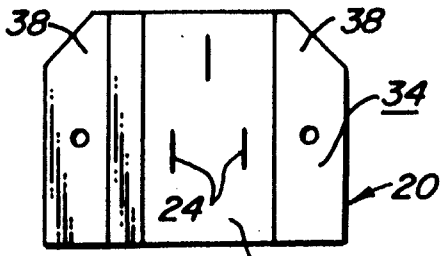
FIG. 6 illustrates the second part of the modular plug of FIG. 4 taken along line 6—6.
Figure 4:
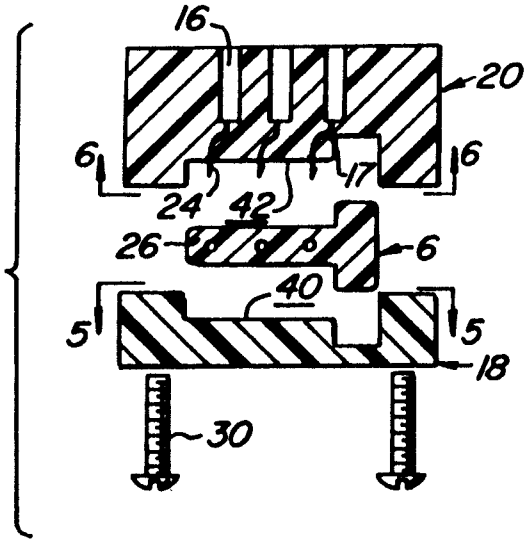
FIG. 4 is a cross-sectional view of the modular plug of FIG. 3 taken along line 4—4.
Figure 5:
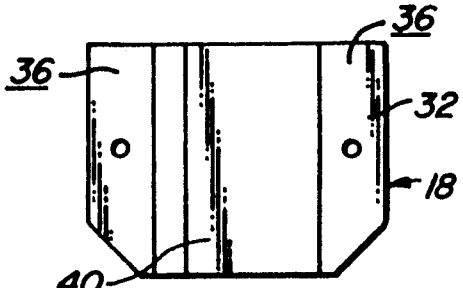
FIG. 5 illustrates the first part of the modular plug of FIG. 4 taken along line 5—5.

Modular socket 4 has first and second parts 18, 20 with opposed surfaces 32 and 34, as shown in FIGS. 5 and 6. Surfaces 32 and 34 have flat, abutting surface portions 36 and 38 and recessed surface portions 40 and 42, respectively. Recessed surface portions 40 and 42 define a cavity 44 sized and shaped for complementary mating engagement with electrical cord 6 as shown in FIG. 4. Recessed surface portion 42 acts as a line engaging surface which matingly engages the asymmetrical line surface 10 of electrical cord 6, as shown in FIG. 4. The T-shaped asymmetrical cross section permits attaching modular plug 4 to either side of electrical cord 6, as shown in FIG. 1, while retaining proper polarity. An isometric view of modular plug 4 is shown in FIG. 7.

Figure 7:
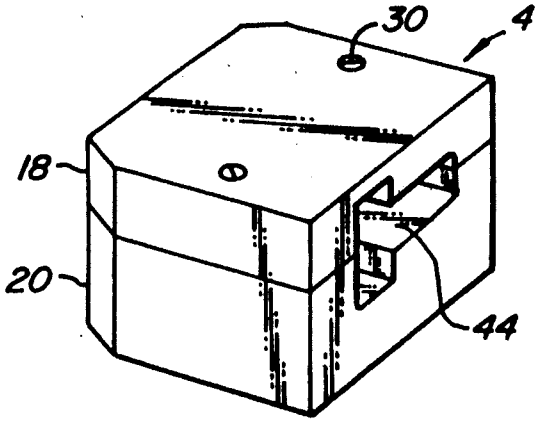
FIG. 7 is an isometric view of the modular plug.

First part 18 and second part 20 are secured to one another and onto electrical cord 6 with screws 30, as shown in FIGS. 4 and 7. Other methods for securing parts 18, 20 together could be used, such as a strap, interlocking elements on first part 18 and second part 20, rivets, or electrical tape.

Modular socket 4 includes spikes 24 extending from recessed surface portion 42 of second part 20. Spikes 24 are positioned to pierce electrical cord 6, pass through insulation 26 and to make electrical contact with the associated conductors 12. Spikes 24 are electrically connected to the appropriate electrical contacts 16 by electrical conductors 17. Spikes 24 pierce insulation 26 when screws 30 are used to secure first 18 and second 20 parts together. Other methods could be used to electrically connect conductors 12 to contacts 16. For example, a portion of insulation 26 could be stripped from electrical cord 8 to expose conductors 12; the exposed conductors 12 would then be covered by a modular socket designed to make electrical contact with the exposed conductors.

After a modular socket 4 has been secured to electrical cord 6, subsequent removal of socket 4 should generally be avoided or steps taken to repair the electrical insulation which had been pierced or removed. To help prevent removal of modular sockets 4, one-way screws or rivets could be used in place of screws 30. Another method would be to use an adhesive either instead of or in conjunction with screws or rivets to secure modular socket 4 to cord 6 or to secure parts 18, 20 to one another, or both.

Modification and variation can be made to the disclosed embodiment without departing from the subject of the invention as defined in the following claims. For example, modular socket 4 could have a one-piece construction or could have other configurations which supply multiple sockets rather than just one. Electrical cord 6 can have any asymmetrical cross section and may have only two conductors 12 contained therein.

What is claimed is:

1. An extension cord comprising:

a flexible electrical cord having a length, an asymmetrical T cross section shape, and a plurality of electrical conductors extending along the length, the asymmetrical cross section being asymmetrical about an axis perpendicular to a line connecting the conductors;

said flexible electrical cord having a first end, the first end having an end plug which has a plurality of electrical prongs, each prong being connected to one of the electrical conductors and said flexible electrical cord having a second end, the second end having a terminal socket which has a plurality of terminal socket contacts, each terminal socket contact being connected to one of the electrical conductors;

a modular socket having a cord T-shaped engaging surface configured for complementary mating engagement with the T-shaped asymmetrical cord surface, said modular socket comprising first and second parts, the first and second parts forming an opening therebetween of substantially the same asymmetrical cross section as the electrical cord, a plurality of electrical contacts in said modular socket;

spike means for electrically coupling the electrical contacts to the electrical conductors when the modular socket is matingly engaged with the asymmetrical cord surface; and means for securing the modular socket to the electrical cord.

2. An extension cord comprising:

a flexible electrical cord having a length, an asymmetrical L cross section shape, and a plurality of electrical conductors extending along the length, the asymmetrical cross section being asymmetrical about an axis perpendicular to a line connecting the conductors;

said flexible electrical cord having a first end, the first end having an end plug which has a plurality of electrical prongs, each prong being connected to one of the electrical conductors and said flexible electrical cord having a second end, the second end having a terminal socket which has a plurality of terminal socket contacts, each terminal socket contact being connected to one of the electrical conductors;

a modular socket having a cord L-shaped engaging surface configured for complementary mating engagement with the L-shaped asymmetrical cord surface, said modular socket comprising first and second parts, the first and second parts forming an opening therebetween of substantially the same asymmetrical cross section as the electrical cord, a plurality of electrical contacts in said modular socket;

spike means for electrically coupling the electrical contacts to the electrical conductors when the modular socket is matingly engaged with the asymmetrical cord surface; and means for securing the modular socket to the electrical cord.

* * * * *